United States Patent [19]

Tierney

[11] 3,944,232

[45] Mar. 16, 1976

[54] GOLF GAME

[76] Inventor: David P. Tierney, 1024 Forestwood Drive, Ferguson, Mo. 63135

[22] Filed: Dec. 16, 1974

[21] Appl. No.: 532,900

[52] U.S. Cl.... 273/176 FB; 273/176 B; 273/176 H; 206/315

[51] Int. Cl.[2]..... A63B 67/02

[58] Field of Search..... 273/87, 87.2, 87.4, 176 R, 273/176 A, 176 E, 176 F, 176 FA, 176 FB, 176 H, 118 R; 206/315

[56] References Cited

UNITED STATES PATENTS

| | | | |
|---|---|---|---|
| 1,761,039 | 6/1930 | Hazeltine | 273/176 H |
| 2,144,439 | 1/1939 | Duffy | 273/176 F |
| 3,558,139 | 1/1971 | Brandell et al. | 273/176 FB X |
| 3,727,918 | 4/1973 | Zawacki | 273/176 FB |
| 3,801,101 | 4/1974 | Greenberg | 273/87.2 X |
| 3,831,949 | 8/1974 | Henning | 273/176 H |
| 3,861,524 | 1/1975 | Coleman | 273/176 FB X |

*Primary Examiner*—Richard C. Pinkham
*Assistant Examiner*—Harry G. Strappello
*Attorney, Agent, or Firm*—Gravely, Lieder & Woodruff

[57] ABSTRACT

A device for playing a game which simulates golf, has front and rear sections which are hinged together and fold from open to closed positions. Both sections rest on the floor with the rear section presented after front section when the device is in its open position. The front section has an open end, while the rear section has a closed end. Both sections have supporting surfaces which align when the sections are open. The supporting surface of the front section is inclined upwardly away from the open end of the front section. A flexible mat having tee positions and other information presented thereon rests on the supporting surfaces and extends out of the open end, beyond which it rests on the floor. The mat may be folded over onto itself so that it rests entirely on the supporting surfaces, and then the front section may be folded over onto the rear section to bring the game device to a compact closed position more suitable for carrying or storage. The mat is contained wholly within the device when the sections are closed.

13 Claims, 7 Drawing Figures

PAR TEE YDS
PAR 7A 694 YDS
OUT OF BOUNDS
LOST BALL
BOGE
DOUBLE BOGEY
INDOOR CLUB

GOLF GAME

BACKGROUND OF THE INVENTION

This invention relates to a device for playing a game which simulates golf.

Heretofore various games have been developed for improving one's skill in golf putting and many of these games may be set up indoors. Usually, the devices are quite large and are difficult to store. Those which are relatively small do not provide the challenge of the larger games and are not as interesting.

SUMMARY OF THE INVENTION

One of the principal objects of the present invention is to provide a golf game which is highly compact and easily stored, yet provides a relatively large surface over which golf balls may be stroked. Another object is to provide a golf game which is interesting and offers a challenge, even to experienced golfers. A further object is to provide a golf game which folds into a rectilinear configuration which houses all the components of the game. An additional object is to provide a game device which is rugged in construction and attractive in appearance.

The present invention is embodied in a golf game having first and second sections which are hinged together to fold between open and closed positions. The sections have supporting surfaces which support a mat. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur.

DETAILED DESCRIPTION

Figures 1, 2, 3, 4, 5, 6, 7:
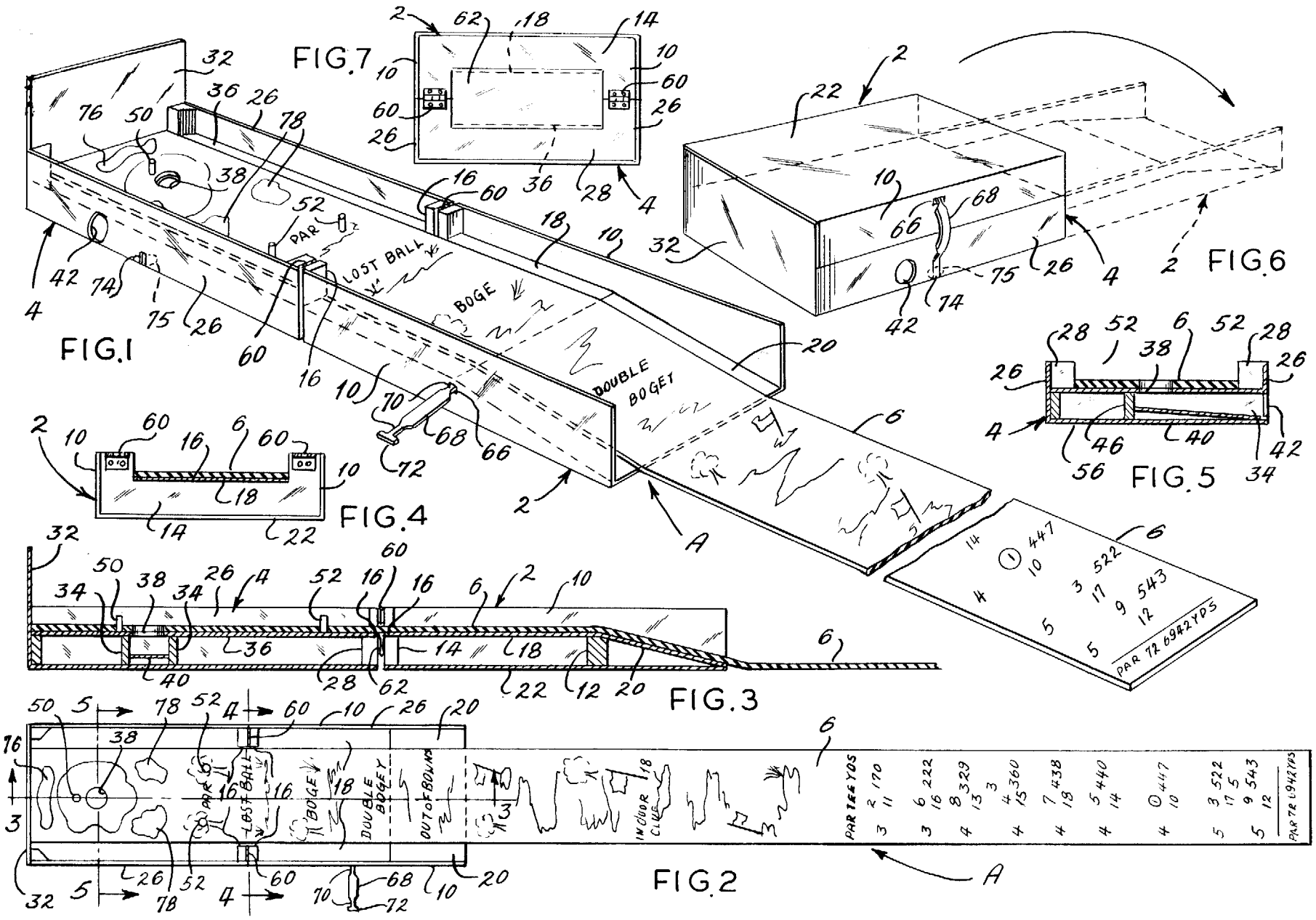
FIG. 1 is a perspective view of the game device of the present invention in its open position.
FIG. 2 is a top view of the game device in its open position with the mat extended over the floor.
FIG. 3 is a longitudinal sectional view taken along line 3—3 of FIG. 2.
FIG. 4 is a sectional view taken along line 4—4 of FIG. 2 and showing the end wall of the first section at the location where the first section pivots relative to the second section.
FIG. 5 is a sectional view taken along line 5—5 of FIG. 2 and showing the return ramp.
FIG. 6 is a perspective view of the game device in its compact closed position, with the front section in its open position being illustrated in phantom.
FIG. 7 is an end view of the game device in its closed position.

Referring now to the drawings, A designates a game device for playing a game which simulates golf. Broadly speaking, the game device A includes front and rear sections 2 and 4 and a runner or mat 6. The front and rear sections 2 and 4 are hinged together so that they can be folded from a compact closed position (FIG. 6), wherein the front section 2 overlies the back section 4, to an open playing position (FIG. 1) wherein the front section 2 forms an extension of the back section 4. The mat 6 is flexible and is further long enough to extend over both the sections 2 and 4 when they are in their open positions and out onto the floor on which the sections 2 and 4 rest.

The front section 2 is hinged to the back section 4 at its one end and is open at its opposite end to enable the mat 6 to enter into it. Along its sides, the front section 2 has sidewalls 10 which are rectangular in shape and are connected by a cross rib 12 (FIG. 3) extending through the interior of the front section and end wall 14 located at the hinged end of the front section 2. The end wall 14 (FIG. 4) has a depressed center portion 16 which is at the same elevation as the top of the rib 12, and extended over and supported on both the depressed center portion 16 and the rib 12 is a horizontal plank 18 which is somewhat below the upper edges of the sidewalls 10. Leading from the open end of the front section 2 to the cross rib 12 is an inclined plank 20, the lower end of which is at floor level, while the upper end is at the elevation of horizontal plank 18. Both the horizontal and inclined planks 18 and 20 extend from one sidewall 10 to the other, and inasmuch as the sidewalls 10 project above the upper surfaces of the planks 18 and 20, they form a border along the sides of the planks 18 and 20. The bottom of the front section is closed by a back wall 22 which is secured to the cross rib 12 and end wall 14 as well as to the sidewalls 10.

The rear section 4 is exactly the same size as the front section 2 and includes sidewalls 26 which align with the sidewalls 10 on the front section 2 (FIG. 1). At the hinged end of the front section 4 the sidewalls 26 are connected by an end wall 28 which is exactly the same shape as the end wall 14 on the front section (FIGS. 4 and 7). Indeed, when the game device is in its open position the end wall 28 on the rear section 4 is located directly opposite the end wall 14 on the floor section 2. Being the same shape as the end wall 14, the end wall 28 likewise has a depressed center portion 16. At its opposite end the back section 2 has another end wall 30 and a back stop 32, the former of which is the same elevation as the depressed portion 16 of the end wall 28, while the latter is about twice the height of the sidewalls 26 and hence projects considerably above them. The back stop 32 is attached to the end wall 28 and forms the closed end of the game device A when that device is open. Extending between the sidewalls 26 are cross ribs 34, (FIGS. 2 and 5) the upper surfaces of which are located about the same elevation as the depressed portion 18 of the end wall 28 and the upper surface of the end wall 20. These surfaces are below the upper edges of the sidewalls 26 and support a horizontal plank 36 which is at the same elevation as the horizontal plank 18 of the front section 2 when the game device A is open. The horizontal plank 36 completely fills the area between the sidewalls 26, and since the sidewalls project above the plank 36, they form a border along its sides. The backstop 32 on the other hand, forms a barrier at the end of the back section 4.

The horizontal plank 36 of the rear section 4 is provided with a circular opening 38 (FIG. 5) midway between the sidewalls 26 and rearwardly from the backstop 32. The opening 38 is somewhat larger than a golf ball and is located directly above the upper end of a discharge ramp 40. The lower end of the ramp 40 is located at a circular opening 42 of equivalent size in one of the sidewalls 26. The upper end of the ramp 40 is closed by an end member 46.

Projecting upwardly from the horizontal plank 36 directly behind circular opening 38 therein is a center peg 50 (FIGS. 1–3). Ahead of this circular opening 38, a pair of lateral pegs 52 project upwardly from the horizontal plank 36, and these pegs are transversely aligned and offset with respect to the longitudinal center of the plank 36. Nevertheless, the lateral pegs 52 are set inwardly from the side margins of the depresed center portion 16 of the end wall 28 so that the possibility exists that a ball passing through the depressed center portion 16 will strike one of the pegs 52.

The bottom of the back section 4 is closed by a back wall 56 (FIG. 3) which conceals the cross ribs 34, the end member 46, and the discharge ramp 40.

The front and rear sections 2 and 4 are joined together at their end walls 14 and 28, respectively, by two hinges 60 (FIGS. 3 and 7), the leaves of which are attached by screws to the opposed faces of the end walls 14 and 28. These hinges are located adjacent to the sidewalls 10 and 26 and laterally beyond the depressed center portions 16 of the walls 14 and 28. The common pivot axis for the hinges 60 lies in the plane of the upper edges for the sidewalls 10 and 26. This enables the front section 2 to be folded over onto the rear section 4, in which case edges of the walls 10 and 26 will come against each other. This is the closed position for the game device A. When in that position depressed center portion 16 of the end wall 14 is located directly above the depressed center portion 16 of the end wall 28 so as to form a rectangular cutout at one end of the closed game device (FIG. 7). The cutout is closed by a flexible web 62, one margin of which is captured between the end wall 14 and the horizontal plank 18 thereon, while the opposite margin thereof is captured between the end wall 28 and the horizontal plank 36.

Still considering the game device when its closed position, one of the sidewalls 10 on front section has a rectangular aperture 66 centered midway between the ends of that wall. This aperture receives the end of a handle 68 (FIGS. 1 and 2) which is preferably molded from a flexible plastic. Actually, the handle 68 is necked inwardly toward its ends to provide reduced portions 70 and at each of its ends is further provided with a pair of laterally projecting lugs 72. The distance from tip-to-tip of the lugs 70 is greater than the length of the rectangular aperture 66. The necked in portion at one end of the handle 68 lies within the aperture 66, in which case the lugs 70 are behind the sidewall 10. Hence, the lugs 70 prevent the handle 68 from being withdrawn from the sidewall 10. The corresponding sidewall 26 on the back section 4 has a slot 74 centered between its ends and opening out of its lower margin. This slot is wide enough to loosely accommodate the reduced portion 70 on the other end of the handle 68, yet is narrow enough to prevent the lugs 72 from passing through it. While the one end of the handle 68 is captured in the rectangular aperture 66, the opposite end can be inserted into and withdrawn from the slot 74 through an aperture 75 (FIGS. 1 and 6) in the back wall 56. This aperture, is, of course, wide enough to accommodate the lugs 72 on the handle 68. The handle 68, not only provides a convenient means of carrying the folded game device A, but also retains the game device A in its folded or closed position.

The flexible mat 6 is about as wide as the depressed center portions 16 on the end walls 14 and 28 so that it can stretch out over the horizontal plank 36 of the back section 4 and the horizontal and inclined planks 18 and 20 of the front section 2 when the game device A is open (FIG. 1). The mat 4, being considerably longer than the combined lengths of the sections 2 and 4, further projects out of the open end of the front section 2, beyond which it is supported on the floor. Near its one end, the mat 6 has relatively small apertures which align with and receive the pegs 50 and 52, thus enabling the mat 6 to drop down and rest on the horizontal plank 36.

The pegs 50 and 52 along with the side edges of the depressed center portion 16 in the end walls 14 and 28 serve to position the mat 6 on the sections 2 and 4 and maintain it centered between the sidewalls 10 and 26. The mat 6 also has an opening which registers with the circular opening 38 in the horizontal plank 36 so that a ball rolling over the mat 6 can drop through the opening 38. The short portion of the mat 4 located beyond the center peg 50 has an irregular cutout 76 (FIGS. 1 and 2) which overlies a blue surface on the horizontal plank 36 of the rear section 4 and thus simulates a lake. Directly behind each lateral peg 52, the mat 6 has two more irregular cutouts 78 which simulate sand traps. Since the mat 6 is narrower than the planks 18, 20 and 36 on which it rests and has thickness of about three-eighths inches, the exposed portions of the planks 18, 20 and 36 located between the side edges of the mat 6 and the sidewalls 10 and 26 of the frames 2 and 4 form depressions or gutters which may be equated to the rough or woods in the regular game of golf.

Printed on the upper surface of the mat 6 is a darkened area which surrounds the circular openings 38 and represents a green. The remaining portions of the mat 6 which overlie the horizontal planks 18 and 36 are marked off in areas which are designated "par," "lost ball," "bogey," and "double bogey," in that order from the green surrounding the circular opening 38. The portion of the mat 6 which overlies the inclined plank 20 is designated "out-of-bounds" and this portion extends out onto the floor a substantial distance. Beyond the out-of-bounds area the mat 6 has 18 tee positions, and each tee position is assigned a specific number of strokes which constitutes par for that position.

OPERATION

A game which closely simulates golf is played on the game device A when the device A is in its open position and the mat 6 is spread out over the planks 36, 18 and 20 and onto the floor beyond the open end of the front section 2.

The player commences the game by placing a golf ball on the first tee position and stroking it with a putter toward the circular opening 38. The ball is stroked until it lands in the circular opening 38 or on the par, bogey or double bogy areas overlying the horizontal planks 18 and 36. The number of strokes for the hole are assigned accordingly. A ball entering one of the gutters, which is designated a woods, is returned to the tee position and stroked over with a one stroke penalty. The same is true of balls entering the cutouts 76 which is considered a lake, or the cutouts 78 which are considered sand traps.

Balls which are stroked excessively hard strike the backstop 32 and are thereby prevented from rolling beyond the game device A. Any ball which enters the circular opening 38 at the green drops onto the return ramp 40 which discharges the ball onto the floor to the side of the game device A.

When in the playing position, the game device is quite long and occupies almost the entire length of an ordinary room. However, the game device is easily and quickly converted into its compact closed position in which it is usually stored or carried. The conversion is accomplished by first folding the flexible mat 6 over upon itself several times until the entire mat 6 overlies only the planks 18, 20 and 36 of the front and rear sections 2 and 4. The handle 68, which is permanently attached to the front section 2, is then grasped and lifted upwardly. This causes the front section 2 to swing upwardly about the axis of the hinges 60. The front section 2 is swung completely over until it rests on the upper edges of the rear section 2, and when the sections 2 and 4 are so disposed the backstop 32 closes the open end of the front section 2. Moreover, the web 62 is unfolded and closes the opening at the opposite end created by the depressed center portions 16. The sidewalls 10 and 26 of the two sections 2 and 4 abut each other along their longitudinal edges and thus close the sides of the game device A. When the front section 2 is folded over onto the rear section 4, the mat 6 also makes one more fold and is completely housed within the interior of the compact game device A. Finally, the lugs 72 at free ends of the handle 68 are inserted into the aperture 75 in the back wall 56 of the rear section 4 and the adjacent reduced portion of the handle 68 is fitted into the slot 74 in the sidewall 26 of the rear section 4. Thus, the handle 68 retains the game device A in its highly compact closed position.

This invention is intended to cover all changes and modifications of the example of the invention herein chosen for purposes of the disclosure which do not constitute departures from the spirit and scope of the invention.

What is claimed is:

1. A device for playing a game which simulates golf, said device comprising first and second sections of substantially equal size which are hinged directly to each other and fold about a hinge axis from an extended open position, wherein both sections are on the floor, to a compact closed position, wherein one section is against the other section, the sections having supporting surfaces which are located below the hinge axis and align when the sections are open, and face each other, yet are spaced a substantial distance apart, when the sections are closed, the first section further having an open end and the supporting surface of that section being substantially at floor level at the open end; and a mat which is substantially longer than the combined lengths of the supporting surfaces, the mat being adapted to rest on the supporting surfaces when the sections are open, the mat being flexible so that it may be folded up upon itself and contained wholly within the space between the supporting surfaces of the sections when the sections are in their closed position.

2. A device according to claim 1 wherein the supporting surface on the first section is at least in part inclined upwardly away from the open end of the first section when the sections are open.

3. A device according to claim 2 wherein the first section is hinged at the end opposite the open end, and the second section has a hinged end and a closed end.

4. A device according to claim 3 wherein the second section has a backstop at its closed end and the backstop extends into and closes the open end of the first section when the sections are closed.

5. A game device according to claim 3 wherein the sections are provided with aligned sidewalls having upper edges which are above the supporting surfaces when the sections are open and abut each other when the sections are closed.

6. A device according to claim 5 and further characterized by a handle attached permanently at its one end to the sidewall of one of the sections and engageable at its other end with the aligned sidewall of the other section.

7. A device according to claim 6 wherein said aligned sidewall of the other section includes a slot which opens out of an edge of that sidewall; and wherein the handle at its other end includes a reduced portion which is small enough to fit into the slot and an enlarged portion located beyond the reduced portion, the enlarged portion being wider than the slot so that when it is behind the sidewall containing the slot, the handle will not pull through that sidewall.

8. A device according to claim 3 wherein the supporting surface on the second section is horizontal when the sections are open and the supporting surface on the first section is inclined in part and horizontal in part when the sections are open with the horizontal portion aligning with the horizontal surface on the second section.

9. A device according to claim 1 where at least one section has a back wall which is presented outwardly when the sections are closed and both sections have sidewalls which are along the sides of the supporting surfaces for their respective sections, the edges of the sidewalls on the one section abutting the edges of the sidewalls on the other section when the sections are in the closed position; one of the sidewalls in said one section having a slot which leads to an aperture in the back wall for said one section, the aperture being wider than the slot; and wherein an elongated handle at its one end is attached to that sidewall of said other section which aligns the sidewall having the slot therein, the other end of the handle having a reduced portion which is narrow enough to fit into the slot and an enlarged portion beyond the reduced portion, the enlarged portion being wider than the slot but narrrower than the aperture so that the reduced portion may be received in the slot when the enlarged portion is passed through the aperture.

10. A device according to claim 3 wherein the supporting surface of the second section has an opening therein, and the second section further has an inclined ramp which underlies the opening and slopes downwardly from the opening toward one side of the second section so that balls which enter the opening will be discharged to the side of the second section.

11. A device for playing a game which simulates golf, said device comprising: first and second sections which are hinged to each other and fold from an extended open position, wherein both sections are on the floor, to a compact closed position, wherein one section is against the other section, the sections having supporting surfaces which align when the sections are open, and face each other, yet are spaced apart, when the sections are closed, the sections being provided with aligned sidewalls having upper edges which are above the supporting surfaces when the sections are open and abut each other when the sections are closed, the first section further having a hinged end and an open end and the supporting surface of that section being substantially at floor level at the open end and at least in part inclined upwardly away from the open end when the sections are open, the second section having a hinged end and a closed end, the sections being hinged together at their hinged ends where the sections are provided with end walls which are in part cut away to substantially the level of the supporting surfaces; and a mat which is substantially longer than the combined lengths of the supporting surfaces, the mat being adapted to rest on the supporting surfaces and being accommodated by the cut away portions of the end walls when the sections are open, the mat being flexible so that it may be folded upon itself and contained wholly between the supporting surfaces of the sections when the sections are in their closed position.

12. A device according to claim 11 wherein the hinge axis about which the sections pivot between their open and closed positions is located at about the level of the upper edges of the sections.

13. A device for playing a game which simulates golf, said device comprising first and second sections which are hinged to each other and fold from an extended open position, wherein both sections are on the floor, to a compact closed position, wherein one section is against the other section, the sections having supporting surfaces which align when the sections are open, and face each other, yet are spaced apart, when the sections are closed, the first section further having a hinged end and an open end and the supporting surface of that section being substantially at floor level at the open end and being inclined in part and horizontal in part when the sections are open, the second section having a hinged end and a closed end and the supporting surface on that section being horizontal and aligning with the horizontal portion of the supporting surface on the first section when the sections are open, the sections being hinged together at their hinged ends, each section further having a pair of sidewalls which extend upwardly above the supporting surfaces when the sections are open, the supporting surface for each section extending from one sidewall to the other for the section; and a mat which is substantially longer than the combined lengths of the supporting surfaces, the mat being adapted to rest on the supporting surfaces when the sections are open, the mat being narrower than the distance between the sidewalls and generally centered between the sidewalls so that the areas of the supporting surfaces located to the sides of the mat form gutters, the mat being flexible so that it may be folded up upon itself and contained wholly between the supporting surfaces of the sections when the sections are in their closed position.

* * * * *